US006308964B1

(12) United States Patent
Chang

(10) Patent No.: US 6,308,964 B1
(45) Date of Patent: Oct. 30, 2001

(54) WHEEL ASSEMBLY FOR A ROLLER SKATE

(76) Inventor: Chun-Cheng Chang, No. 492-16, Chia-Li Hsing, Chia-Li Chen, Tainan Hsien (TW)

( * ) Notice: Subject to any disclaimer, the term of this patent is extended or adjusted under 35 U.S.C. 154(b) by 0 days.

(21) Appl. No.: 09/325,379

(22) Filed: Jun. 4, 1999

(30) Foreign Application Priority Data

Dec. 19, 1998 (TW) ..... 087221300

(51) Int. Cl.[7] ..... A63C 17/00

(52) U.S. Cl. ..... 280/11.19; 280/7.13; 280/11.23; 280/11.25; 280/11.26; 280/11.27; 36/115

(58) Field of Search ..... 280/7.13, 11.26, 280/11.23, 11.25, 11.27; 36/115

(56) References Cited

U.S. PATENT DOCUMENTS 3,979,842 * 9/1976 Texidor ..... 36/115
3,983,643 * 10/1976 Schreyer et al. ..... 36/115
5,312,120 * 5/1994 Wiegner ..... 280/11.2
5,803,469 * 9/1998 Yoham ..... 280/11.22 X
6,065,759 * 5/2000 Wu ..... 280/11.22

* cited by examiner

*Primary Examiner*—Lanna Mai
*Assistant Examiner*—Toan To
(74) *Attorney, Agent, or Firm*—Bacon & Thomas

(57) ABSTRACT

A wheel assembly for a roller skate includes a pivotal seat having a first end secured to a base of the roller skate, a wheel seat having a first end pivotally connected to a second end of the pivotal seat by a pin, and a wheel rotatably mounted to a second end of the wheel seat. A first elastic member has a first end attached to the pivotal seat and a second end attached to a mounting member on the wheel seat for biasing the wheel seat to a storage position in the base. A stopping member includes a first end mounted to the pin and a second end through which the mounting member is extended. A second elastic member is mounted around the pin for biasing a stop of the stopping member to a position for releasably engaging with the wheel seat to prevent the wheel seat from moving into the storage position in the base when the wheel seat and the wheel are extended beyond the base for skating.

5 Claims, 6 Drawing Sheets

WHEEL ASSEMBLY FOR A ROLLER SKATE

BACKGROUND OF THE INVENTION

1. Field of the Invention

The present invention relates to a roller skate and a wheel assembly for the roller skate.

2. Description of the Related Art

The wheels of a typical roller skate are fixed to an underside of the roller skate, and the user has to wear a pair of shoes (generally sport shoes) before putting the roller skates on. The user cannot walk on rugged surfaces when wearing the roller skates. Thus, the user faces troublesome actions of putting on and taking off of the roller skates when he/she starts or stops skating.

Taiwan Utility Model Publication No. 339688 issued on Sep. 1, 1998 discloses a roller skate includes a base and a number of wheels that can be pivoted to storage positions in the base such that the user may directly walk through rugged surfaces without troublesome actions of taking off and re-putting on of the roller skates. As can be seen from FIG. 7 of the drawings, the base 1 includes two shoulder sections 2 to which the wheel seats 3 may bear against during skating. However, when walking on an inclined surface, one of the wheel seats 3 might be pivoted into the storage compartment 4 in the base 1. The wheel seats 3 might also be pivoted into the storage compartments 4 if they impinge objects on the ground. The skater might be injured as a result of losing balance.

The present invention is intended to provide a wheel assembly for a roller skate that mitigates and/or obviates the above problem.

SUMMARY OF THE INVENTION

It is a primary object of the present invention to provide a roller skate having two wheel assemblies that can be moved to the storage positions when not in use and that can be retained in operative statuses when skating.

A wheel assembly for a roller skate in accordance with the present invention comprises:

- a pivotal seat having a first end secured to a base of the roller skate and a second end;
- a wheel seat having a first end pivotally connected to the second end of the pivotal seat by a pin and a second end;
- a wheel rotatably mounted to the second end of the wheel seat, the wheel seat further including a mounting member;
- a first elastic member having a first end attached to the pivotal seat and a second end attached to the mounting member of the wheel seat for biasing the wheel seat to a storage position in the base;
- a stopping means including a first end mounted to the pin and a second end through which the mounting member is extended, the stopping means further including a stop; and
- a second elastic member mounted around the pin for biasing the stop of the stopping means to a position for releasably engaging with the wheel seat to prevent the wheel seat from moving into the storage position in the base.

By such arrangement, the wheel seat may be moved into the base when not skating. When skating is required, the wheel seat and the wheel are extended beyond the base, and the stop may prevent the wheel seat from entering the base during skating, thereby preventing potential injury to the skater.

The present invention also provides a roller skate that comprises:

- a base having at least two compartments, the base further having a corresponding number of shoulders defined in said at least two compartments, respectively;
- a corresponding number of wheel assemblies each of which is mounted in an associated said compartment, each said wheel assembly including:
  - a pivotal seat having a first end secured to the base and a second end,
  - a wheel seat having a first end pivotally connected to the second end of the pivotal seat by a pin and a second end,
  - a wheel rotatably mounted to the second end of the wheel seat, the wheel seat further including a mounting member,
  - a first elastic member having a first end attached to the pivotal seat and a second end attached to the mounting member of the wheel seat for biasing the wheel seat into the associated compartment in the base;
  - a stopping means including a first end mounted to the pin and a second end through which the mounting member is extended, the stopping means further including a stop; and
  - a second elastic member mounted around the pin for biasing the stop of the stopping means to a position for releasably engaging with the wheel seat; and
- an upper mounted on top of the base.

Each wheel seat is pivotable between an operative position and a storage position in the associated compartment. When each wheel seat is in the operative position, each wheel seat bears against an associated shoulder while the wheel rotatably attached to each wheel seat extends beyond the base for skating. In addition, when each wheel assembly is in the operative position, the stop of each stopping means is engagable with an associated wheel seat to prevent the associated wheel seat from entering the associated compartment.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
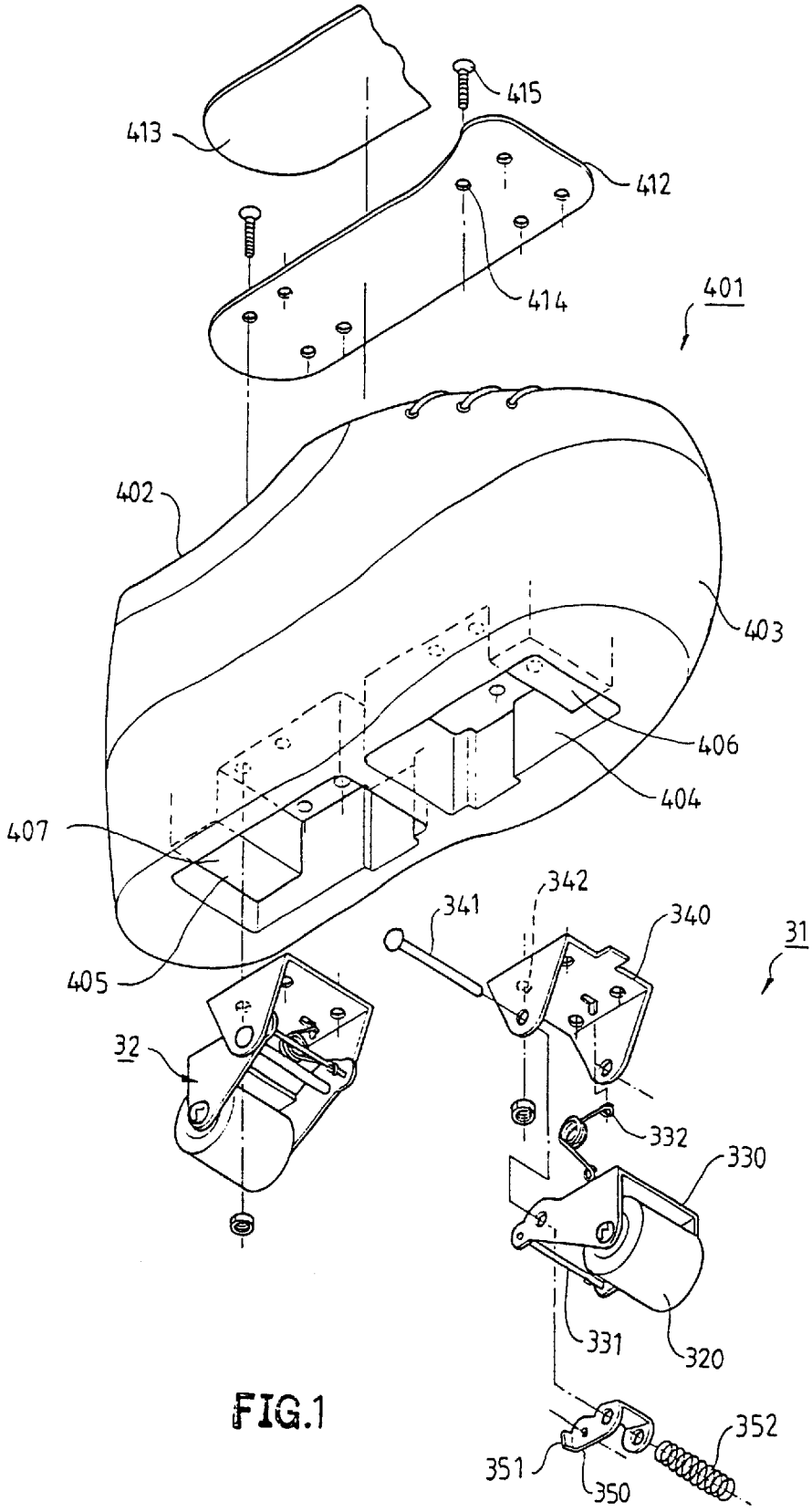
FIG. 1 is an exploded perspective view of a roller skate in accordance with the present invention.
Figure 2:
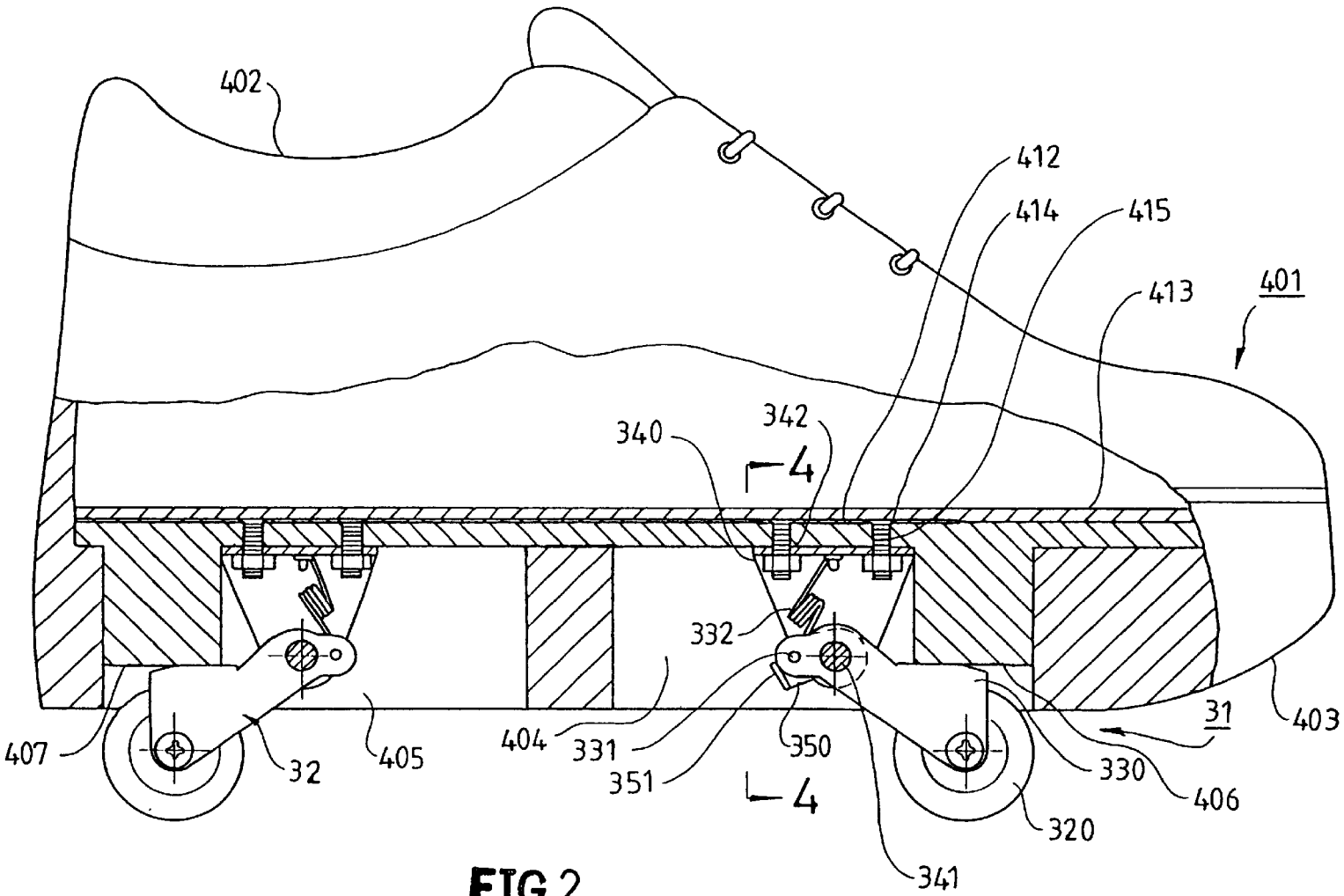
FIG. 2 is a side view, partially sectioned, of the roller skate in accordance with the present invention, wherein the wheels are in operative positions.

Referring to FIGS. 1 and 2, a roller skate in accordance with the present invention generally includes a base or sole 403 having two compartments 404 and 405 defined therein, a bottom plate 412 mounted to an upper side of the base 403, two wheel assemblies 31 and 32 attached to an underside of the bottom plate 403, and a stopping means 350. As can be seen from FIG. 2, the compartment 404 receives the wheel assembly 31, while the compartment 405 receives the wheel assembly 32. The base 403 further includes two shoulders 406 and 407 defined in the compartments 404 and 405, respectively A soft padding plate 413 may be provided on top of the bottom plate 412. An upper 401 is attached to the base 403 and includes an interior 402 for receiving the foot of the skater, which is conventional and therefore not further described.

The bottom plate 412 includes a number of positioning holes 414. Each wheel assembly 31, 32 includes a pivotal seat 340 having a first end attached to the underside of the base 403 by means of extending fasteners (e.g., bolts 415) through associated positioning holes 414 in the bottom plate 412, positioning holes 408 in the base 403, and positioning holes 342 in the pivotal seat 340. Each pivotal seat 340 further includes a second end to which an end of a wheel seat 330 is pivotally connected by means of extending a pin 341 through holes 343 in the pivotal seat 340 and holes 333 in the wheel seat 330. The other end of each wheel seat 330 includes a wheel 320 rotatably mounted thereto. An elastic member, e.g., a torsion spring 332 is attached between the pivotal seat 340 and a mounting member 331 on the wheel seat 330 for biasing the wheel seat 330 to its storage position in the associated compartment 404, 405.

The stopping means 350 includes a first end pivotally connected to the pin 341 (by means of extending the pin 341 through holes 353 in the stopping means 350) and a second end with a hole 354 through which the mounting member 331 extends. The stopping means 350 further includes a stop 351. A further elastic member, e.g. a coil spring 353 is mounted around the pin 341 and attached between the first end of the stopping means 350 and the wheel seat 330 (FIG. 4).

Figure 3:
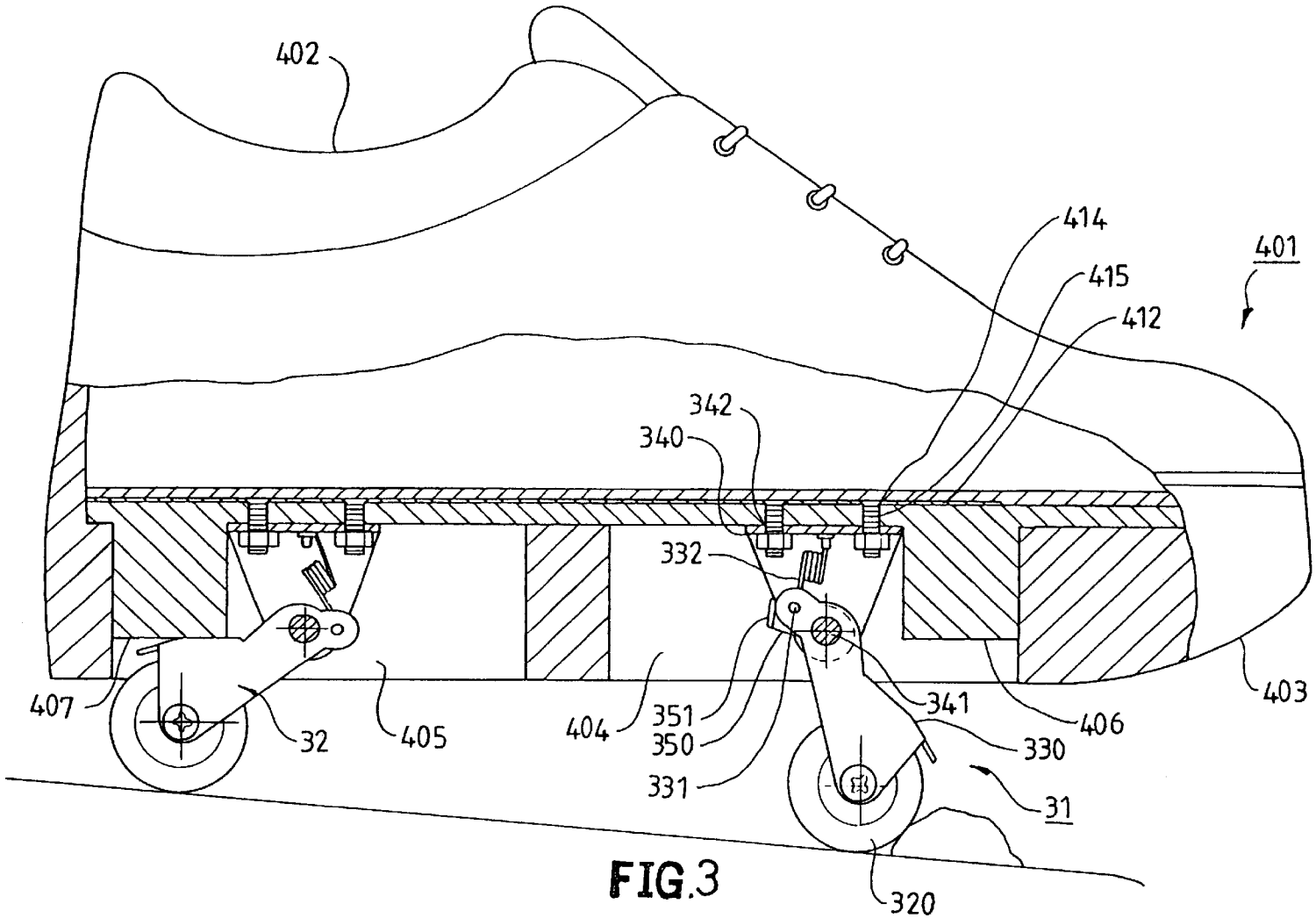
FIG. 3 is a side view similar to FIG. 2, wherein the roller skate is passing through a decline.

When the wheel seats 330 are pivoted to extend beyond the base 403, the wheel seats 330 bear against the shoulders 406 and 407, respectively. Thus, the roller skate may perform its skating function, as shown in FIG. 2. Referring to FIG. 3, when skating on a decline, the front wheel seat 31 moves away from the shoulder 406 and pivots through an angle until the stop 351 of the stopping means 350 engages with and is thus stopped by the pivotal seat 340, thereby preventing further pivotal movement of the wheel seat 330, as shown in FIG. 4. Thus, the wheel seat 330 will not move into its storage compartment 404, i.e., the wheel seat 330 is retained in its operative status for skating to thereby avoid potential injury to the skater.

Figure 4:
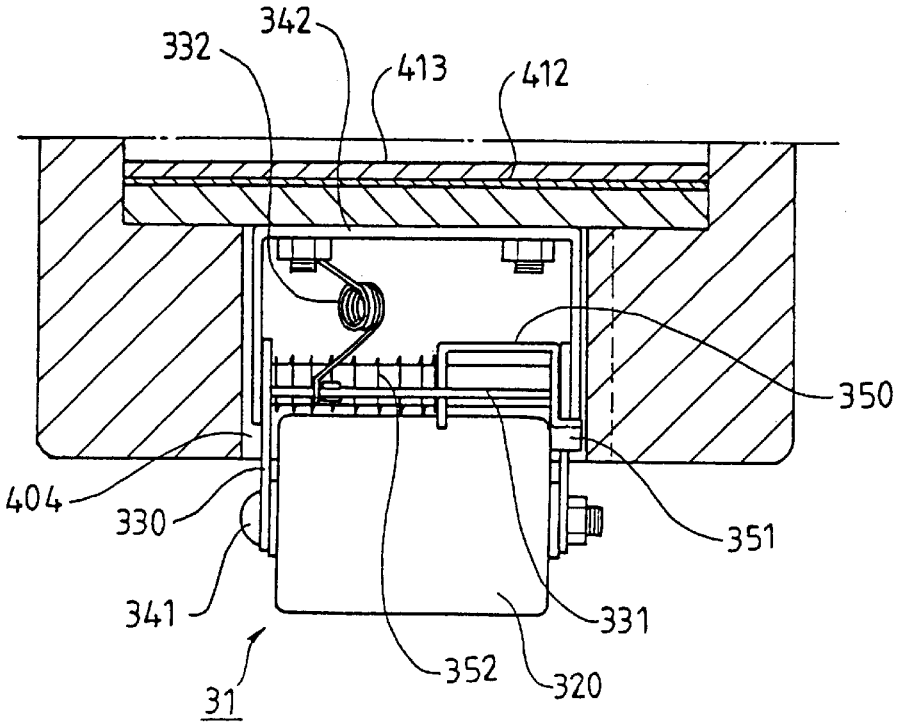
FIG. 4 is a cross sectional view illustrating operation of a stopping means of the roller skate.
Figure 5:
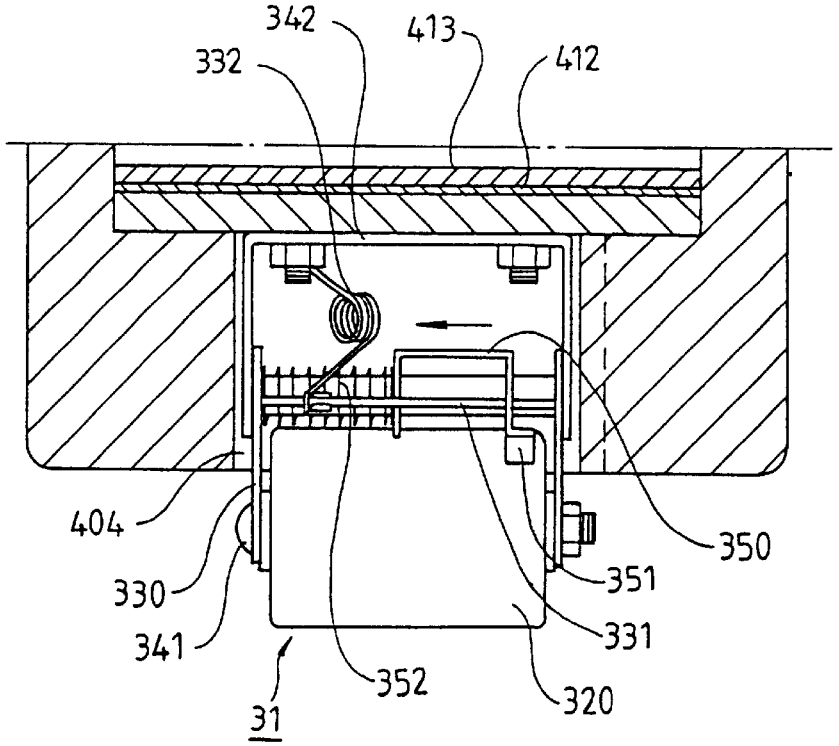
FIG. 5 is a view similar to FIG. 4, wherein the stopping means is in a status allowing the wheel seat to move to a storage position.
Figure 6:
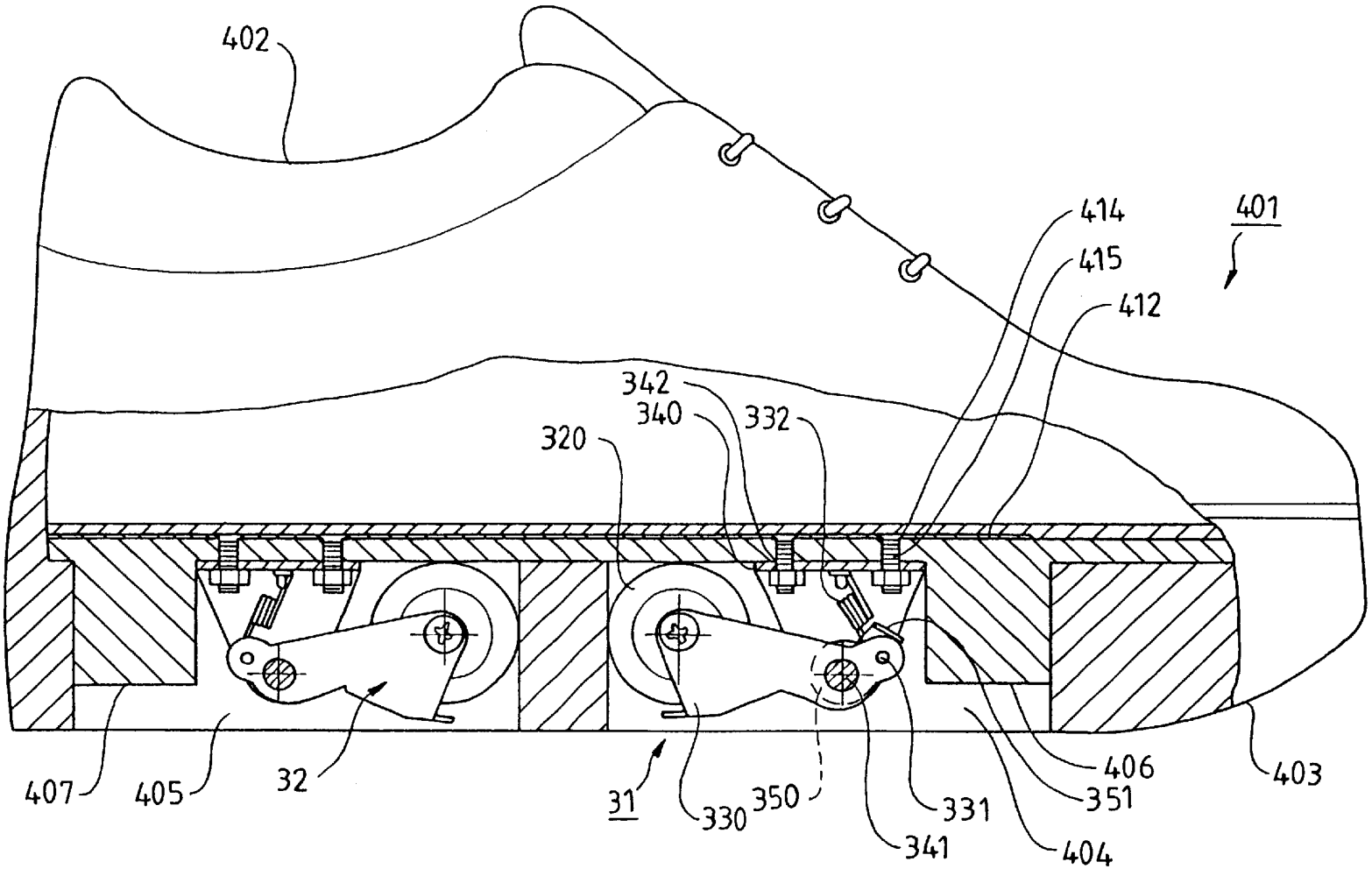
FIG. 6 is a side view similar to FIG. 2, wherein the wheels are in storage positions.
Figure 7:
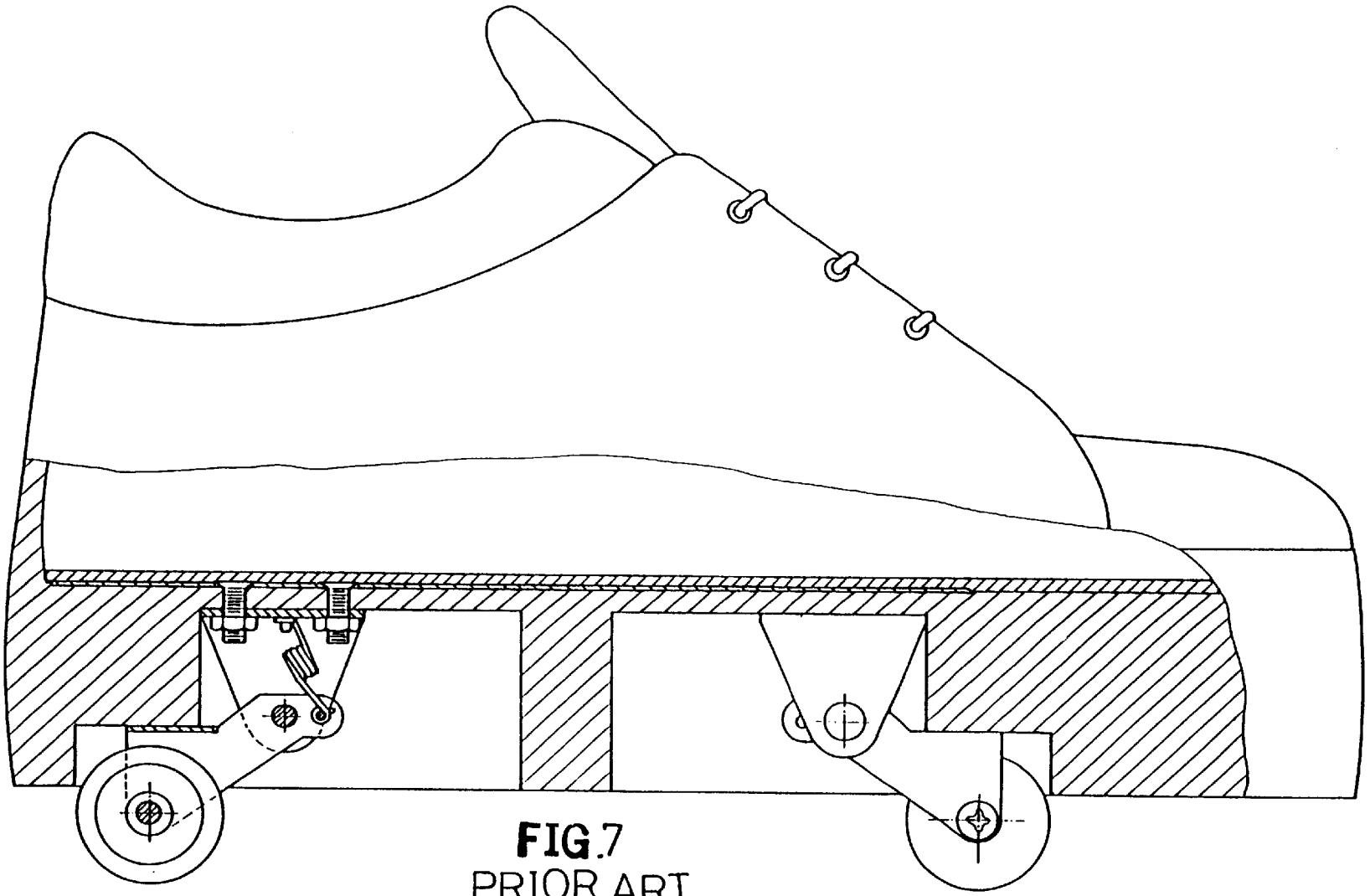
FIG.7 PRIOR ART
FIG. 7 is a side view, partially sectioned, of a conventional roller skate.

As can be seen from FIG. 4, the stopping means 350 is biased by the elastic member 352 toward a side of the wheel seat 330 such that the stop 351 may bears against the pivotal seat 340 to prevent movement of the wheel seat 330 into the compartment 404. Referring to FIG. 5, when not skating, the stopping means 350 may be moved axially away from the side of the wheel seat 330 such that the wheel seat 330 may move into the compartment 404 under the action of the elastic member 332, as the stop 351 is not on the way of the wheel seat 330 into the compartment 404. As a result, the wheel seats are moved into the storage positions when not skating, as shown in FIG. 6. Thus, the roller skate can be used as a normal shoe.

According to the above description, it is appreciated that the wheel seats in accordance with the present invention may be received in the compartments in the base when not skating, and the wheel seats are prevented from entering into the compartments when skating, thereby preventing potential injury to the skater.

Although the invention has been explained in relation to its preferred embodiment, it is to be understood that many other possible modifications and variations can be made without departing from the spirit and scope of the invention as hereinafter claimed.

The embodiment of the invention in which an exclusive property or privilege is claimed are defined as follow:

1. A wheel assembly for a roller skate having a base, the wheel assembly comprising:

a pivotal seat having a first end secured to the base and a second end;

a wheel seat having a first end pivotally connected to the second end of the pivotal seat by a pin and a second end;

a wheel rotatably mounted to the second end of the wheel seat, the wheel seat further including a mounting member;

a first elastic member having a first end attached to the pivotal seat and a second end attached to the mounting member of the wheel seat for biasing the wheel seat to a storage position in the base;

a stopping means including a first end mounted to the pin and a second end through which the mounting member is extended, the stopping means further including a stop; and a second elastic member mounted around the pin, said second elastic member being adapted to bias the stop of the stopping means to a position for releasably engaging with the wheel seat to prevent the wheel seat from moving into the storage position in the base.

2. A roller skate comprising:

a base having at least two compartments, the base further having a corresponding number of shoulders defined in said at least two compartments, respectively;

a corresponding number of wheel assemblies each of which is mounted in an associated said compartment, each said wheel assembly including:

a pivotal seat having a first end secured to the base and a second end, a wheel seat having a first end pivotally connected to the second end of the pivotal seat by a pin and a second end, a wheel rotatably mounted to the second end of the wheel seat, the wheel seat further including a mounting member;

a first elastic member having a first end attached to the pivotal seat and a second end attached to the mounting member of the wheel seat for biasing the wheel seat into the associated compartment in the base;

a stopping means including a first end mounted to the pin and a second end through which the mounting member is extended, the stopping means further including a stop; and a second elastic member mounted around the pin, said second elastic member being adapted to bias the stop of the stopping means to a position for releasably engaging with the wheel seat; and an upper mounted on top of the base;

wherein each said wheel seat is pivotable between an operative position and a storage position in the associated compartment, and wherein when each said wheel seat is in the operative position, each said wheel seat bears against an associated said shoulder while the wheel rotatably attached to each said wheel seat extends beyond the base for skating, and wherein when each said wheel assembly is in the operative position, the stop of each said stopping means is engagable with an associated said wheel seat to prevent the associated wheel seat from entering the associated compartment.

3. The roller skate as claimed in claim 2, wherein the base further including a rigid bottom plate mounted to an upper side thereof, and further including a plurality of fasteners extended through the bottom plate, the base, and the pivot seats.

4. The wheel assembly of claim 1 wherein said second elastic member is a coil spring having one end in contact with said first end of the stopping means and a second end in contact with said wheel seat.

5. Roller skate of claim 2 wherein said second elastic member is a coil spring having one end in contact with said first end of the stopping means and a second end in contact with said wheel seat.

* * * * *